US009555931B2

(12) United States Patent
Blythe

(10) Patent No.: US 9,555,931 B2
(45) Date of Patent: Jan. 31, 2017

(54) SLIDER BAG WITH HANDLE BELOW THE ZIPPER TRACK

(75) Inventor: James S. Blythe, Libertyville, IL (US)

(73) Assignee: REYNOLDS CONSUMER PRODUCTS LLC, Lake Forest, IL (US)

( * ) Notice: Subject to any disclaimer, the term of this patent is extended or adjusted under 35 U.S.C. 154(b) by 2007 days.

(21) Appl. No.: 11/758,412

(22) Filed: Jun. 5, 2007

(65) Prior Publication Data

US 2008/0089618 A1 Apr. 17, 2008

(51) Int. Cl.

| | |
|---|---|
| ***B65D 33/06*** | (2006.01) |
| ***B65D 33/08*** | (2006.01) |
| ***B65D 33/10*** | (2006.01) |
| ***B65D 33/14*** | (2006.01) |
| ***B65D 33/25*** | (2006.01) |
| *B65D 33/16* | (2006.01) |

(52) U.S. Cl.

CPC ..... *B65D 33/2591* (2013.01); *B65D 33/06* (2013.01); *B65D 33/065* (2013.01); *B65D 33/08* (2013.01); *B65D 33/10* (2013.01); *B65D 33/16* (2013.01); *B65D 33/25* (2013.01); *B65D 33/2508* (2013.01)

(58) Field of Classification Search

CPC ..... B65D 33/2591; B65D 33/2541; B65D 33/2508; B65D 33/255; B65D 33/2525; B65D 33/2558; B65D 33/2566; B65D 33/2533; B65D 33/2516; B65D 33/06; B65D 33/065; B65D 33/08; B65D 33/10; B65D 33/105; B65D 33/12; B65D 33/14; B65D 33/16; B65D 33/25; B65D 33/2805

USPC ..... 383/10, 25, 6, 7, 12, 14, 16, 21, 61.2, 383/63–65, 9, 22, 24, 42, 97, 203, 204, 383/17, 20, 61.1, 61.3

See application file for complete search history.

(56) References Cited

U.S. PATENT DOCUMENTS

| | | | | |
|---|---|---|---|---|
| 3,132,742 | A | 5/1964 | Shapiro et al. | |
| 3,240,420 | A * | 3/1966 | Membrino | B65D 75/566 383/10 |
| 3,462,069 | A | 8/1969 | Suominen | |
| 3,506,185 | A | 4/1970 | Houman | |
| 3,774,837 | A * | 11/1973 | Franson | 383/10 |
| 3,782,622 | A | 1/1974 | Montgomery | |
| 3,797,733 | A | 3/1974 | Ibing | |
| 4,946,290 | A * | 8/1990 | Matyja | 383/10 |
| 5,174,657 | A | 12/1992 | Peppiatt | |
| 5,362,153 | A | 11/1994 | Lu | |
| 5,480,230 | A | 1/1996 | May | |

(Continued)

FOREIGN PATENT DOCUMENTS

| | | | | |
|---|---|---|---|---|
| GB | 2253244 A * | 9/1992 | | A44B 19/16 |
| WO | WO 9008704 A2 * | 8/1990 | | B65D 33/38 |
| WO | WO 02/06130 | 1/2002 | | |

OTHER PUBLICATIONS

WO9008704 Translation.*
U.S. Appl. No. 29/261,163, filed Jun. 7, 2006 (Sep. 7, 2010).
U.S. Appl. No. 29/367,141, filed Aug. 3, 2010.
U.S. Appl. No. 29/261,163, May 9, 2008 Requirement for Restrictions/Election.
U.S. Appl. No. 29/261,163, Jun. 6, 2008 Response to Election/Restriction.

(Continued)

*Primary Examiner* — Jes F Pascua
*Assistant Examiner* — Nina Attel
(74) *Attorney, Agent, or Firm* — Baker Botts L.L.P.

(57) ABSTRACT

A bag including opposing panels, a closed bottom and a reclosable top. The bag further includes a closure assembly along the reclosable top and a handle assembly joined to one of the panels.

23 Claims, 8 Drawing Sheets

(56) References Cited

U.S. PATENT DOCUMENTS

| | | | | |
|---|---|---|---|---|
| 5,611,626 | A | 3/1997 | Warr | |
| D385,487 | S | 10/1997 | Gonthier | |
| 5,788,378 | A * | 8/1998 | Thomas | 383/63 |
| 5,882,120 | A * | 3/1999 | Bell | 383/204 |
| 6,053,635 | A * | 4/2000 | Anderson et al. | 383/10 |
| 6,257,763 | B1 * | 7/2001 | Stolmeier | B65D 33/2591 383/5 |
| 6,361,209 | B1 * | 3/2002 | LaRue et al. | 383/10 |
| 6,378,177 | B1 | 4/2002 | Athans et al. | |
| 6,464,394 | B1 * | 10/2002 | Galomb | 383/10 |
| 6,843,600 | B2 | 1/2005 | Tilman et al. | |
| 6,886,980 | B1 * | 5/2005 | Diplock | 383/10 |
| 7,014,363 | B2 * | 3/2006 | Hanson | 383/120 |
| 7,207,154 | B2 | 4/2007 | Araujo | |
| 7,263,748 | B2 | 9/2007 | Blythe | |
| 7,419,300 | B2 * | 9/2008 | Pawloski et al. | 383/14 |
| 2003/0077006 | A1 * | 4/2003 | Siegel | 383/10 |
| 2003/0185466 | A1 | 10/2003 | Edelman et al. | |
| 2003/0236159 | A1 * | 12/2003 | Worthy, Jr. | 493/394 |
| 2004/0052436 | A1 * | 3/2004 | Buchanan | B65D 33/02 383/98 |
| 2004/0109616 | A1 * | 6/2004 | Winiecki | 383/64 |
| 2004/0109617 | A1 * | 6/2004 | Winiecki | 383/64 |
| 2004/0234173 | A1 | 11/2004 | Saad et al. | |
| 2005/0152620 | A1 * | 7/2005 | Diplock | 383/10 |
| 2005/0157956 | A1 * | 7/2005 | Geyer | 383/5 |
| 2005/0185863 | A1 * | 8/2005 | Carrillo | 383/10 |
| 2005/0244084 | A1 | 11/2005 | Tilman et al. | |
| 2005/0271306 | A1 * | 12/2005 | Murray | 383/38 |
| 2005/0281487 | A1 | 12/2005 | Pawloski et al. | |
| 2006/0078233 | A1 * | 4/2006 | Winiecki | B31B 19/86 383/104 |
| 2006/0182369 | A1 * | 8/2006 | Schneider et al. | 383/10 |
| 2006/0188177 | A1 * | 8/2006 | Dyer | B65D 33/08 383/10 |
| 2006/0233466 | A1 * | 10/2006 | Mantzivis | 383/21 |
| 2007/0065048 | A1 * | 3/2007 | Eads et al. | 383/6 |
| 2007/0098305 | A1 | 5/2007 | Tilman | |

OTHER PUBLICATIONS

U.S. Appl. No. 29/261,163, Jun. 27, 2008 Non-Final Office Action.
U.S. Appl. No. 29/261,163, Oct. 27, 2008 Response to Non-Final Office Action.
U.S. Appl. No. 29/261,163, Jan. 22, 2009 Final Office Action.
U.S. Appl. No. 29/261,163, Apr. 14, 2009 Examiner Interview Summary.
U.S. Appl. No. 29/261,163, May 22, 2009 Response to Final Office Action.
U.S. Appl. No. 29/261,163, Jun. 26, 2009 Non-Final Office Action.
U.S. Appl. No. 29/261,163, Jul. 1, 2009 Examiner Interview Summary.
U.S. Appl. No. 29/261,163, Oct. 21, 2009 Examiner Interview Summary.
U.S. Appl. No. 29/261,163, Oct. 26, 2009 Response to Non-Final Office Action.
U.S. Appl. No. 29/261,163, Jan. 12, 2010 Ex-Parte Quayle Action.
U.S. Appl. No. 29/261,163, Mar. 12, 2010 Response to Quayle Action.
U.S. Appl. No. 29/261,163, May 3, 2010 Examiner Interview Summary.
U.S. Appl. No. 29/261,163, May 3, 2010 Notice of Allowance.
U.S. Appl. No. 29/261,163, Aug. 3, 2010—Issue Fee Payment.
U.S. Appl. No. 29/261,163, Aug. 18, 2010—Issue Notification.
U.S. Appl. No. 29/367,141, Dec. 2, 2010 Non-Final Office Action.
U.S. Appl. No. 29/367,141, Mar. 2, 2011 Response to Non-Final Office Action.
U.S. Appl. No. 29/367,147, May 13, 2011 Final Office Action.
U.S. Appl. No. 29/367,141, Sep. 8, 2011 Ex Parte Quayle Action.
U.S. Appl. No. 29/367,141, Aug. 12, 2011 Response to Final Office Action.

* cited by examiner

SLIDER BAG WITH HANDLE BELOW THE ZIPPER TRACK

This application claims priority to provisional patent Application Ser. No. 60/812,027 filed on Jun. 7, 2006.

BACKGROUND OF THE INVENTION

Polymeric bags are widely used in a diverse number of households, as well as commercial facilities. Polymeric bags are used for a wide range of applications, such as for storage and food packaging, for example. One advantage of polymeric bags is that they are relatively cost efficient and can be reused if desired. Further, polymeric bags having a closure assembly provide a bag that is easily opened and reclosed. Reclosable bags often include a closure assembly such as a reclosable fastener or zipper mechanism. Advantageously, the closure feature enables the bag to be reopened and reclosed countless times.

Another desirable feature of polymeric bags includes one or more handles for ease of handling and carrying by a consumer. Conventional, heavy-duty polymeric bags with handles typically include a die-cut hole in the top portion of the body of the bag. This design disadvantageously distributes an exerted stress due to the weight of the bag contents on the handle. The exerted stress sometimes has a force that causes the handle to rip. Additionally, in bags having a closure device, the increase in stress exerted to the bag often causes premature and undesired opening of the closure assembly, or the stress causes damage to the closure assembly. Other disadvantages of conventional bags include a polymeric bag having the handles disposed at the top portion of the bag, which extends upwardly above the perimeter of the bag or above the closure assembly. In this manner, the location of the handles hinder the opening and closing of the closure assembly.

Accordingly, there exists a need for a reclosable polymeric bag having a closure assembly and handles which displace an exerted force caused by the weight of the bag's contents away from the closure assembly. There also exists a need for a reclosable polymeric bag having a closure assembly and handles that do not inhibit access to the closure assembly when opening or closing the closure assembly, or when inserting or removing the bag's contents.

Also, the manufacturing process is made easier by this configuration.

SUMMARY OF THE INVENTION

The present invention relates to a reclosable bag, such as a polymeric bag, which includes a first panel and a second panel joined to each other along a pair of opposing sides, a bottom connecting the first and second panels to each other, and a reclosable top defined opposite the bottom and along a width of the bag. The bag further includes a closure assembly extending along the reclosable top of the bag and a handle assembly joined to at least one of the first or second panels.

The handle assembly includes a first handle section having a top section, a bottom section, opposing first and second side edges and an opening defined in a central section thereof. The handle section is joined to the first or second panels. Preferably, the bottom section of the handle section is joined to a portion of the first or second panels along a width thereof. In one embodiment, the width of the handle section and the panel to which it is joined is substantially the same and the handle section is joined to the panel along its entire width.

The top section of the handle section is preferably unattached to the panels. In one embodiment, the top section of the handle assembly is disposed at least 0.25 inch (about 0.635 centimeters) below the closure assembly such that the top portion of the handle does not extend above the closure assembly.

In a preferred embodiment, in addition to the bottom section of the handle assembly being joined to a width of one of the panels, each of the first and second side edges of the handle assembly is joined to at least one of the first and second panels. For example but not limitation, the first and second side edges are joined to the first and second side sections of one of the first and second panels, respectively. In this regard, the handle assembly includes bottom section and first and second side edges joined to one of the panels. The top section of the handle assembly is unattached to the panel.

Preferably, the handle assembly includes first and second handle assemblies disposed on opposite sides of the bag. In this manner, a first handle section is joined to a first panel and a second handle section is joined to the second panel.

For example, the first handle section can include a bottom section joined to a width of the first panel and first and second side edges joined to the first and second side sections of the first panel, respectively. The second handle can include a bottom section joined to a width of the second panel and first and second side edges joined to the first and second side sections of the second panel, respectively. Each of the first and second handle assemblies has a centrally disposed opening sized for entry of a hand, or alternatively, a series of openings sized for entry of the fingers of a hand. The opening defined in the first handle section is aligned with the opening defined in the second handle section.

The closure assembly can include a fastener configured to be operated by finger pressure or by an auxiliary squeezing device (e.g., a press-to-close fastener). In this manner, the fastener includes first and second tracks or profiles configured to engage each other by for example, forming an interlocking connection by the application of a force. The first and second profiles can be disengaged by pulling the profiles apart.

In an alternative embodiment, the closure assembly includes a zipper extending along the reclosable top and a slider slidably mounted on the zipper. The slider is configured to open and close the zipper. In this regard, the zipper can include first and second tracks or profiles configured to engage each other such as by an interlocking connection. For example, the first and second profiles can include complementary rib and grooves that form an interlocking connection with each other when the slider is in a closed position. Further, the interlocking connection between the rib and groove profiles can be disengaged when the slider is in an open position.

DESCRIPTION OF THE PREFERRED EMBODIMENTS

Reference will now be made in detail to the present preferred embodiments of the invention, an example of which is illustrated in the accompanying drawings.

In accordance with the invention, a bag is provided having a closed bottom, a reclosable top disposed opposite the bottom, and opposing first and second panels joined to each other. The bag further includes a closure assembly disposed along the reclosable top of the bag and a handle assembly joined to at least one of the first or second panels. Preferably, the handle assembly is disposed below the closure assembly.

Figure 1:
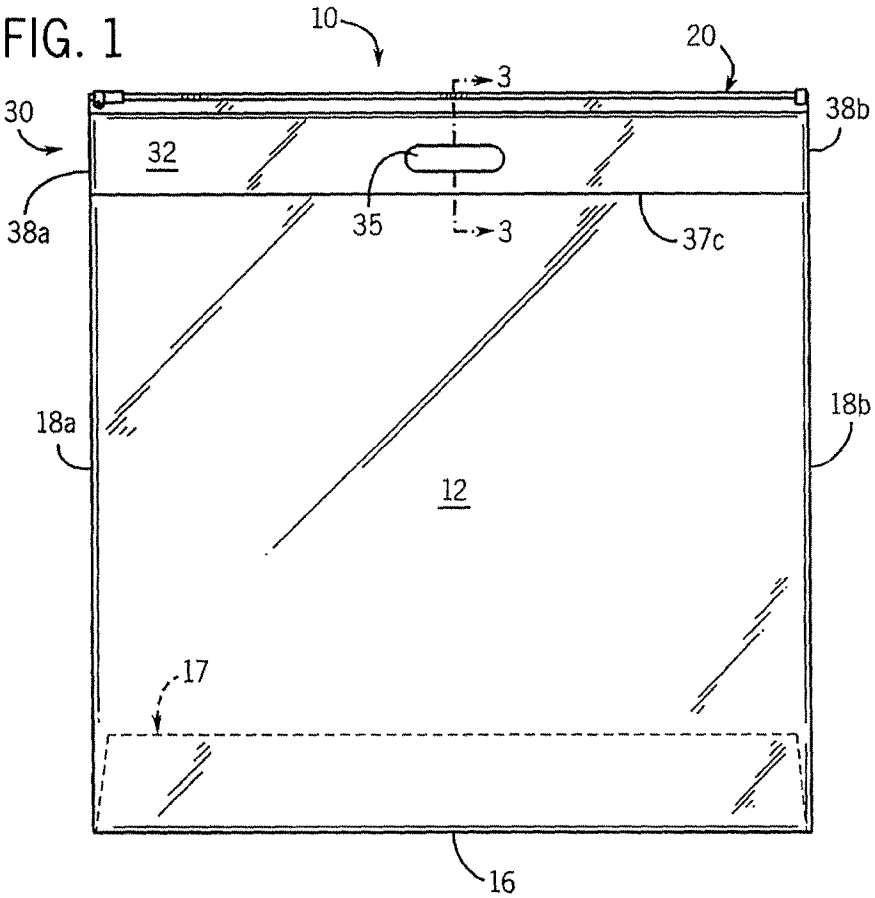
FIG. 1 is a schematic illustration of one embodiment of a bag in accordance with the invention.

For purpose of illustration, and not limitation, an exemplary embodiment of the bag in accordance with the invention is shown in FIG. 1 and is designated generally as reference number 10. Additional features, aspects and embodiments of a bag in accordance with the invention are provided in FIGS. 2-10, as will be described.

Figure 2:
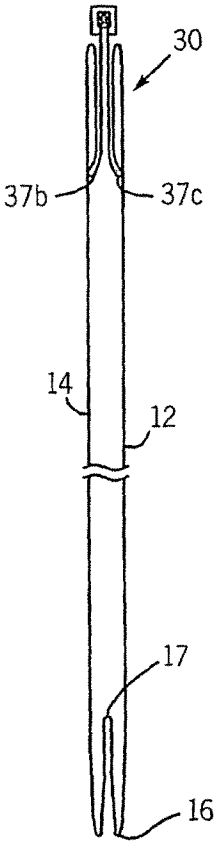
FIG. 2 is a schematic illustration of the side view of another embodiment of the bag in accordance with the invention.

As shown in FIGS. 1 and 2, bag 10 comprises first and second opposing body panels 12, 14. In one embodiment, body panels 12, 14 are joined or fixedly connected to each other along first and second sides 18*a*, 18*b*, respectively. As shown in FIG. 1, bottom 16 extends between the first and second sides 18*a*, 18*b*. Further, bottom 16 connects the first panel 12 to the second panel 14. Preferably, as best viewed in FIG. 2, the bottom wall is a gusseted bottom wall 17 comprising gusseted portions.

The first and second panels can be made from two separate sheets joined along three sides, e.g., bottom and opposing sides. Alternatively, the first and second panels can be formed from a unitary folded sheet. The unitary sheet can include a side fold or a bottom fold.

First and second panels 12, 14 can be formed from a wide range of materials. Preferably, the panels are formed from polymeric material, for example and not limitation, polyesters; polystyrenes; nylon; polypropylene; polyethylene; copolymers of polyethylene and polypropylene; polycarbonates; polyacetals; acrylic-butadiene-styrene copolymers; monolayer or multilayer polyethylene, such as a low density polyethylene (LDPE), a linear low density polyethylene (LLDPE), high density polyethylenes (HDPE), and/or ethylene vinyl acetate, and/or a co-polymer mixture, multilayer combination, or laminate(s) thereof, or combinations thereof. However, as would be recognized in the art, other thermoplastic materials may be used to form the panels of the bag.

In addition, the first and second panels of the bag may be formed from coextruded films having two or more layers. Each of the first and second panels preferably has a thickness ranging from about 0.4 mil to about 10 mils. In one preferred embodiment, the thickness is 3.5 mils. However, depending on the application contemplated for the bag, other thicknesses may be used, if desired.

Figure 3:
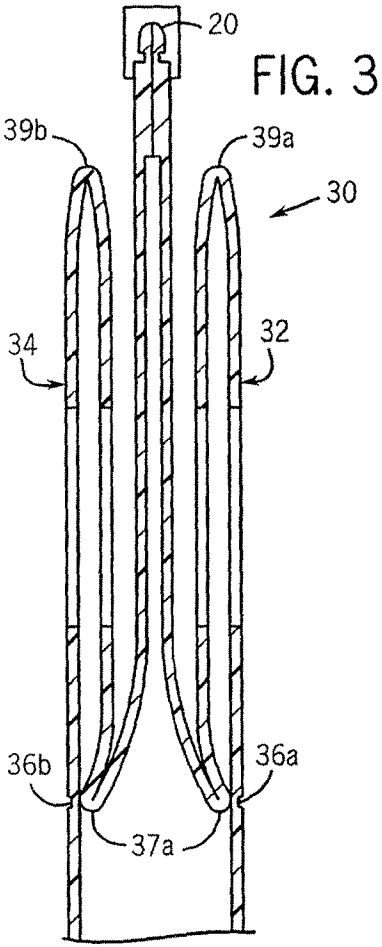
FIG. 3 is a schematic cross-sectional view taken along line 3 of FIG. 1.
Figure 4:
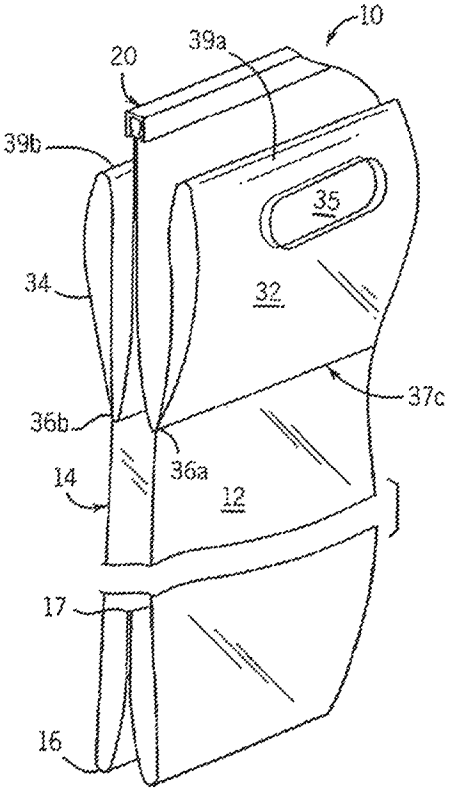
FIG. 4 is a schematic illustration of the bag of FIG. 2 in accordance with the invention.

In one aspect of the invention, bag 10 comprises a handle assembly 30, as shown in FIGS. 3 and 4. In one embodiment, the handle assembly 30 includes a first handle section 32 and a second handle section 34 joined or fixedly connected to first and second side panels 12, 14, respectively. For example and not limitation, at least one of handle section 32 or handle section 34 is attached to first 12 or second panels 14, respectively, by heat sealing, ultrasonic sealing, or adhesive sealing. Alternatively, the attachment can be by a mechanical means, for example and not limitation, rivets, staples, bolts or tabs in slots, or tape woven through slots. However, as would be known in the art, other suitable techniques may be used.

In a preferred embodiment, as shown in FIGS. 1 and 3, the first handle section 32 includes a bottom end 36*a*, a top end 39*a*, and first and second side edges 38*a*, 38*b*. Similarly, the second handle section 34 includes a bottom end 36*b*, a top end 39*b*, and first and second side edges 38*a*, 38*b*. The bottom ends 36*a*, 36*b* of first and second handle sections 32 and 34 include an attachment point 37*a* to connect each of the first and second handle sections 32, 34 to panels 12 and 14, respectively. Additionally, each handle section further includes an opening 35 defined in a central portion thereof. The opening 35 is preferably sized to allow a hand of a user to fit through.

In a preferred embodiment, each of the top portions 39*a* and 39*b* of the first and second handle sections are unattached to the bag 10. Further, the handle assembly 30 including top portions 39*a*, 39*b* of each handle section 32, 34 and opening 35 is disposed below the reclosable top of the bag 10 and below the closure assembly 20, as shown in FIG. 3. In another preferred embodiment, the top sections 39*a* and 39*b* of the first and second handle section are at least 0.25 inch (about 0.635 centimeters) below the closure assembly 20. In this manner, the closure assembly 20 is unhindered by the handle assembly 30 and provides easy access to open and close the closure assembly.

The handle sections 32, 34 can be formed from a separate member that is fixedly attached to the bag. In this regard, at least the bottom section 36*a*, 36*b* of the first or second handle sections is joined to the first or second panels of bag 10. Preferably, the bottom section 36*a*, 36*b* has a width that is substantially equal to the width of the panel 12, 14 and the bottom section 36*a*, 36*b* is preferably sealed to the panel to define a seal line 37*c*, 37*b* along the width of each of the handle sections and the panel.

Alternatively, the handle sections can be formed from the panels 12, 14 of the bag. In this manner, a particular length of the first or second panel 12, 14 is folded to define a lateral wing extending from the plane of the panel. Further, a portion of the lateral wing is sealed to the surface of the panel to define a handle assembly.

In an embodiment, as shown in FIGS. 1, 2, 3 and 5, the bottom section 36*a*, 36*b* of handle section 32, 34 is sealed to the bag along seal line 37*c*, 37*b* and each side edge 38*a*, 38*b* of each handle section 32, 34 is sealed to the panel at the sides 18*a*, 18*b*. In this manner, the handle section is joined to bag at each of its sides and along its bottom section. Further, top section 39*a*, 39*b* is unattached to the bag.

In accordance with the invention, handle assembly 30 is configured to displace an exerted force from the closure assembly to prevent undesired opening or damage to the closure assembly 20. In this regard, attaching the handle assembly 30 to the panels 12, 14 below the closure assembly 20 causes substantially less exerted force on the closure assembly 20 when the bag is lifted by the handles than conventional bags. By reducing the external forces on the closure assembly 20, the risk of undesired bag opening is decreased.

Figure 5:
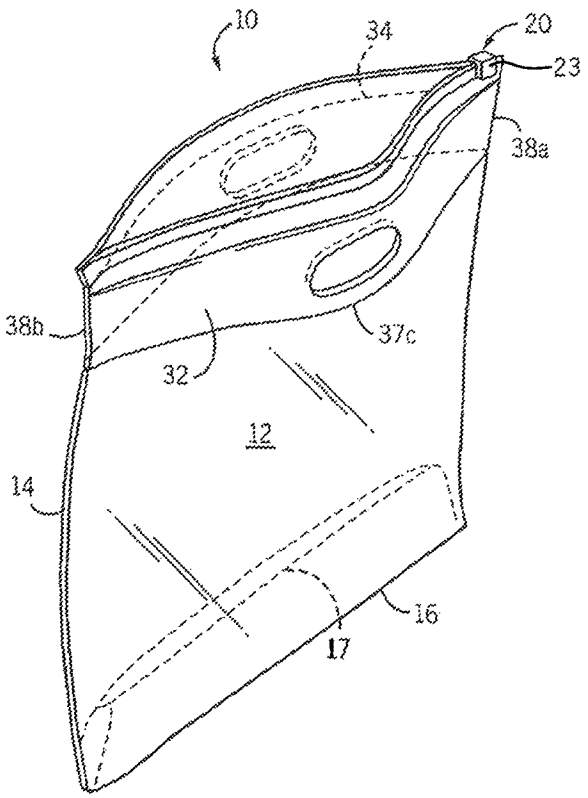
FIG. 5 is a schematic perspective view of the bag of FIG. 1 in accordance with the invention.
Figure 8:
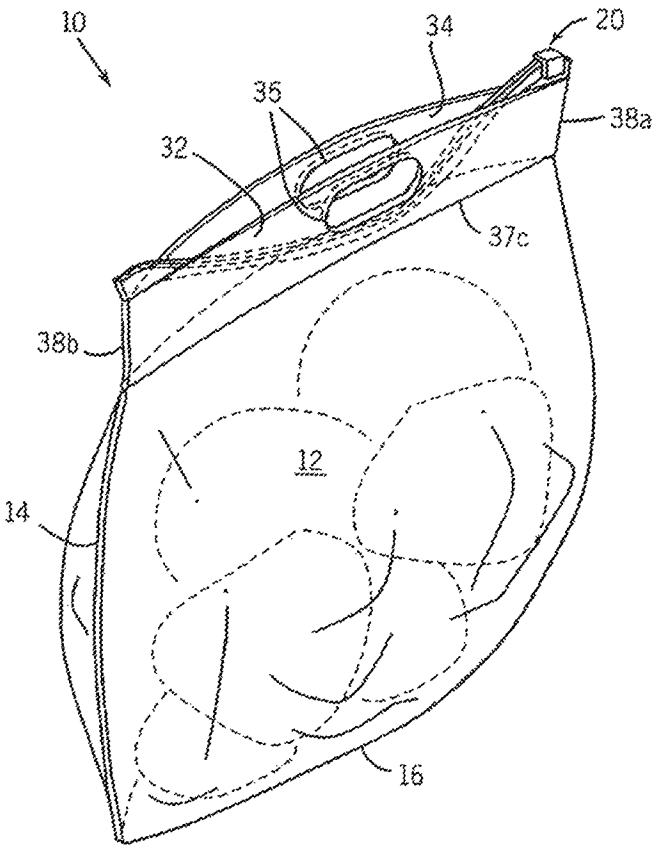
FIG. 8 is a schematic view of the bag of FIG. 1 including contents therein.

In a preferred embodiment, as shown in FIG. 5, bag 10 includes a gusset 17 disposed proximate to a bottom section 16. In operation, the gusset is configured to unfold and define an upright standing bag. As items are placed in the bag 10 and the internal volume of the bag increases or expands, the closure assembly 20 transitions from a location disposed above the opening 35 defined in each handle section to a location disposed below opening 35, as shown in FIG. 8. In this manner, unhindered access to opening 35 is provided. Prior to the bag interior being filled up with items, the handle assembly 30 is disposed below the closure assembly. Advantageously, such construction provides unhindered access to operate the closure assembly, facilitating, for example, easy filling of the bag. Thereafter, when the bag is filled with contents, the closure assembly transitions to define a bag having accessible handle sections, and in particular accessible opening 35 for easy handling of the filled bag. For the purpose of illustration, a stand-up polymeric bag is shown in U.S. Pat. No. 6,148,588 to Thomas et al., the entire content of which is incorporated herein by reference.

Figure 7:
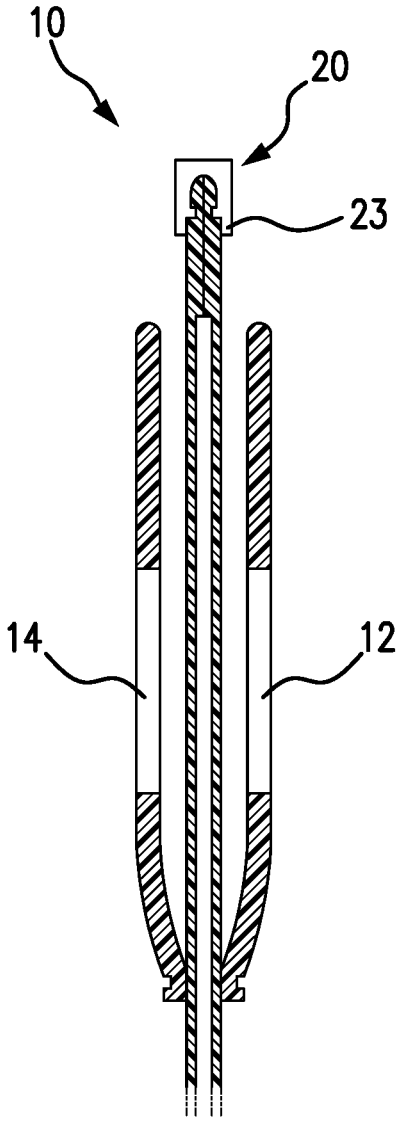
FIG. 7 is a schematic cross-sectional view taken along line 3 of FIG. 1

The handle sections 32, 34 are preferably formed from two layers of a thermoplastic material as shown in FIG. 3, or a single layer of a thermoplastic material as shown in FIG. 7. Preferably, the polymeric material is the same as the material which forms side panels 12, 14. However, the handle sections can be formed from a material different from that of the panels.

A variety of materials may be used to form handle sections. Preferably, the handle sections are polymeric. For example and not limitation, suitable polymeric materials include but are not limited to polyesters; polystyrenes; nylon; polypropylene; polyethylene; copolymers of polyethylene and polypropylene; polycarbonates; polyacetals; acrylic-butadiene-styrene copolymers; monolayer or multilayer polyethylene, such as a low density polyethylene (LDPE), a linear low density polyethylene (LLDPE), high density polyethylenes (HDPE), and/or ethylene vinyl acetate, and/or a co-polymer mixture, multilayer combination, or laminate(s) thereof; or combinations thereof.

The handle sections 32 and 34 may have substantially the same thickness as the side panels 12, 14. However, if desired, the handle sections can have a thickness that is lesser or greater than the thickness of the side panels 12, 14. The thickness of the handle sections 32 and 34 may be selected depending on the intended application for the bag. In this regard, considerations such as average stress placed on the handle sections 32 and 34, the economic feasibility of producing multiple thermoplastic layers of varying thickness, and certain tactile considerations can be contemplated.

Further, the thicknesses of the handle sections 32, 34 may be the same or different from one another and/or the sections may have thicknesses that vary within each of the sections. If it is desired to make the handle sections 32 and 34 stronger, the handle could be formed by using any of the aforementioned materials and co-extruding same with a high density polyethylene or by laminating a strong plastic, such as polyethylene terephalate or an oriented polypropylene thereto.

In a further aspect of the invention, the closure assembly includes a fastener configured to open and close the reclosable top section of the bag. In one embodiment, the fastener comprises a first fastener track attached to a first side panel and a second fastener track attached to a second side panel, wherein first and second fastener tracks are disposed in an opposing relationship on the first and second panels, respectively. The tracks may comprise integrally formed profiles and fins. In another embodiment, the closure assembly fastener may be configured to be operated by finger pressure or by an auxiliary squeezing device, whereby the first and second tracks are squeezed together (e.g., as in a press-to-close fastener). In this manner, the closure assembly fastener includes first and second tracks configured to form an interlocking connection by the application of a force.

In one preferred embodiment, the closure assembly includes a reclosable zipper. In this manner, the reclosable zipper is operated by the use of an auxiliary slider mechanism, by finger pressure, or by an auxiliary squeezing device.

Figure 6:
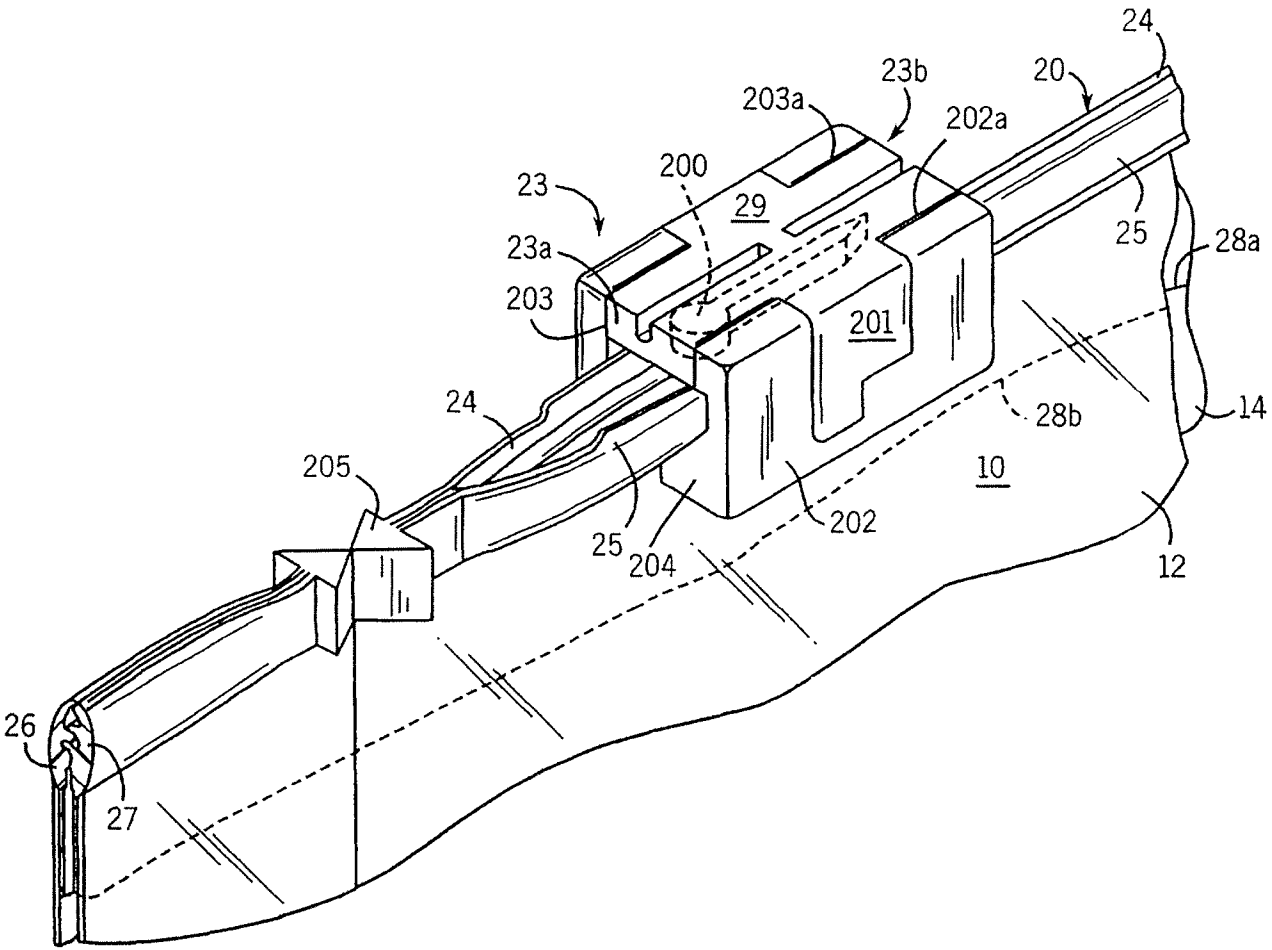
FIG. 6 is an enlarged perspective view of one embodiment of the closure assembly in accordance with the invention.

Preferably, as shown in FIG. 6, the closure assembly is a zipper 20 including a slider mechanism 23, and first track 24, and second track 25 configured to form an interlocking connection.

For example and not limitation, first and second tracks can include complementary rib 26 and groove 27 profiles which extend along a length of the closure assembly. The rib and groove profiles 26, 27 are configured to have complementary cross-sectional shapes. The cross-sectional shapes of the interlocking rib and groove profiles 26, 27 shown in FIG. 6 are the subject of the invention claimed in U.S. Pat. No. 5,007,143 to Herrington which is incorporated herein by reference in its entirety. In this manner, the ribs 26 form a mating relationship with corresponding grooves 27.

The rib track 24 includes a rib profile 26 and a first depending fin or flange 28*a* extending downward from the rib profile 26. Likewise, the groove track 25 includes a groove profile 27 and a second depending fin or flange 28*b* extending downward from the groove profile 27. The fins 28*a*, 28*b* are shown attached to opposing body panels 12, 14. The tracks 24, 25 may be extruded separately with fins 28*a*, 28*b* and attached to the respective sides of the bag mouth or the tracks 24, 25 may be extruded integral with the sides of the bag mouth. If the tracks 24, 25 are extruded separately, they are most effectively attached by means of the respective first and second fins 28*a*, 28*b*, incorporated within the tracks, such as by heat sealing to the bag mouth.

In one embodiment, slider 23, as illustrated in FIG. 6, and described in U.S. Pat. No. 5,896,627 to Cappel et al. which is incorporated herein by reference in its entirety, is slidingly mounted to closure assembly 20 disposed at the reclosable top of the bag 10. The slider 23 is configured to facilitate the engagement and disengagement of the first and second tracks 24, 25 of the closure assembly. In this manner, slider 23 is configured to transition between a closed position in which the first and second tracks are engaged, and an open position in which the first and second tracks are disengaged.

As the slider transitions from a closed position to an open position, first and second tracks 24, 25 progressively disengage to define an open bag so that a user can gain access to the interior of the bag 10. Further, movement of the slider 23 from an open position to a closed position facilitates the interlocking connection between the first and second tracks, e.g., rib and groove profiles 26, 27, thereby restricting access to the interior of the bag 10. For example, the rib and groove profiles 26, 27 may be rolled or pressed into their interlocking arrangement so as to securely close the bag by one of two means. First, the profiles may be rolled or pressed together at one end by a user and then sequentially fitted together along the length of the closure assembly by the user running a finger along the length of the closure assembly on each side of the profiles. Alternatively, the bag may include a slider that rides along the tracks of the closure assembly. If the slider is pulled in one direction, the bag is closed; if the slider is pulled in the opposite direction, the bag is reopened.

In one embodiment, as shown in FIG. 6, the slider 23 comprises an inverted generally U-shaped member including a transverse support member or body 29 from which the separator finger 200 extends downward. The body 29 is itself U-shaped and includes two integral legs 201 extending downward. The finger 200 is positioned between the legs 201. The body 29 is adapted to move along the top edges of the tracks 24, 25 with the legs 201 straddling these elements and the finger 200 positioned between the tracks 24, 25. The slider 23 also includes a pair of hinged "wings" 202, 203 that can be folded down into their final position. The wings 202, 203 are hinged to the main slider body 29 by means of hinge structures 202*a*, 203*a* located at the opposite ends of the legs 201.

The foldable depending wings or side walls 202, 203 extend from an opening end 23*b* of the slider 23 to a closing end 23*a*. It is noted that the main slider body 29 and the separator finger 200 are wider at the opening end 23*b* than at the closing end 23*a*. Similarly, the side walls 202, 203 and the legs 201 are spaced wider apart at the opening end 23*b* of the slider 23 to permit separation of the rib and groove profiles 26, 27 by the finger 200 engaging the tracks 24, 25. The wings 202, 203 and legs 201 are spaced sufficiently close together at the closing end 23*a* of the slider to press the rib and groove profiles 26, 27 into an interlocking relationship as the slider 23 is moved in a closure assembly closing direction. As shown in FIG. 6, the side walls 202, 203 at their lower ends are provided with an inwardly extending shoulder structure 204. Shoulder structure 204 engages a bottom of the closure assembly 20 to prevent slider 23 from being lifted off the edges of the tracks 24, 25 while the slider 23 straddles the closure assembly 20.

The slider 23 may be molded from any suitable polymeric material including, but not limited to, polyesters; polystyrenes; nylon; polypropylene; polyethylene; copolymers of polyethylene and polypropylene; polycarbonates; polyacetals; acrylic-butadiene-styrene copolymers; monolayer or multilayer polyethylene, such as a low density polyethylene (LDPE), a linear low density polyethylene (LLDPE), high density polyethylenes (HDPE), and/or ethylene vinyl acetate, and/or a co-polymer mixture, multilayer combination, or laminate(s) thereof; or combinations thereof.

The opposing ends of the closure assembly 20 can include end stop structures 205 as shown in FIG. 6 and U.S. Patent Application Publication US2004/0066985A1 by Patel et al. which is incorporated herein by reference in its entirety. A portion of the end stop structures protrudes from the closure assembly 20 a distance adequate to engage the slider 23 and prevent the slider 23 from going past the respective ends of the closure assembly 20 and coming off the ends of the bag 10. A portion of the end stops may protrude an adequate distance in the transverse direction to engage the slider 23 and prevent movement of the slider 23 past the respective ends of the closure assembly 20. As used herein, transverse means any direction which is normal to the axis of the track. For example, a portion of the end stops may protrude an adequate distance in a generally horizontal or generally vertical direction to engage the slider 23 and prevent movement of the slider 23 past the respective ends of the closure assembly 20. Additionally or alternatively, a portion of the end stops may protrude an adequate distance upwardly and/or outwardly from a remainder of the closure assembly 20 to engage the slider 23 and prevent movement of the slider 23 past the respective ends of the closure assembly 20. Additional details concerning the formation of the end stops may be obtained from U.S. Pat. No. 5,131,121 to Herrington, which is incorporated herein by reference in its entirety. In some embodiments, the thicknesses of the end stops at their widest point may vary from generally about 0.005 inches to about 0.2770 inches.

Figure 9:
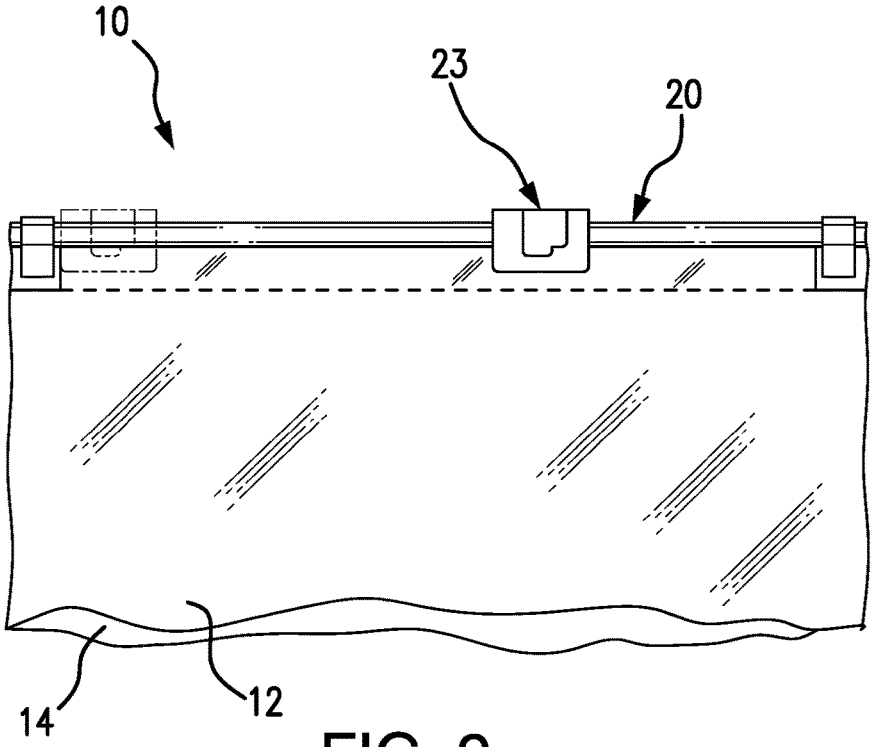
FIG. 9 is a side elevation view of an embodiment of the reclosable fastener with self-locking slider mounted on the bag.
Figure 10:
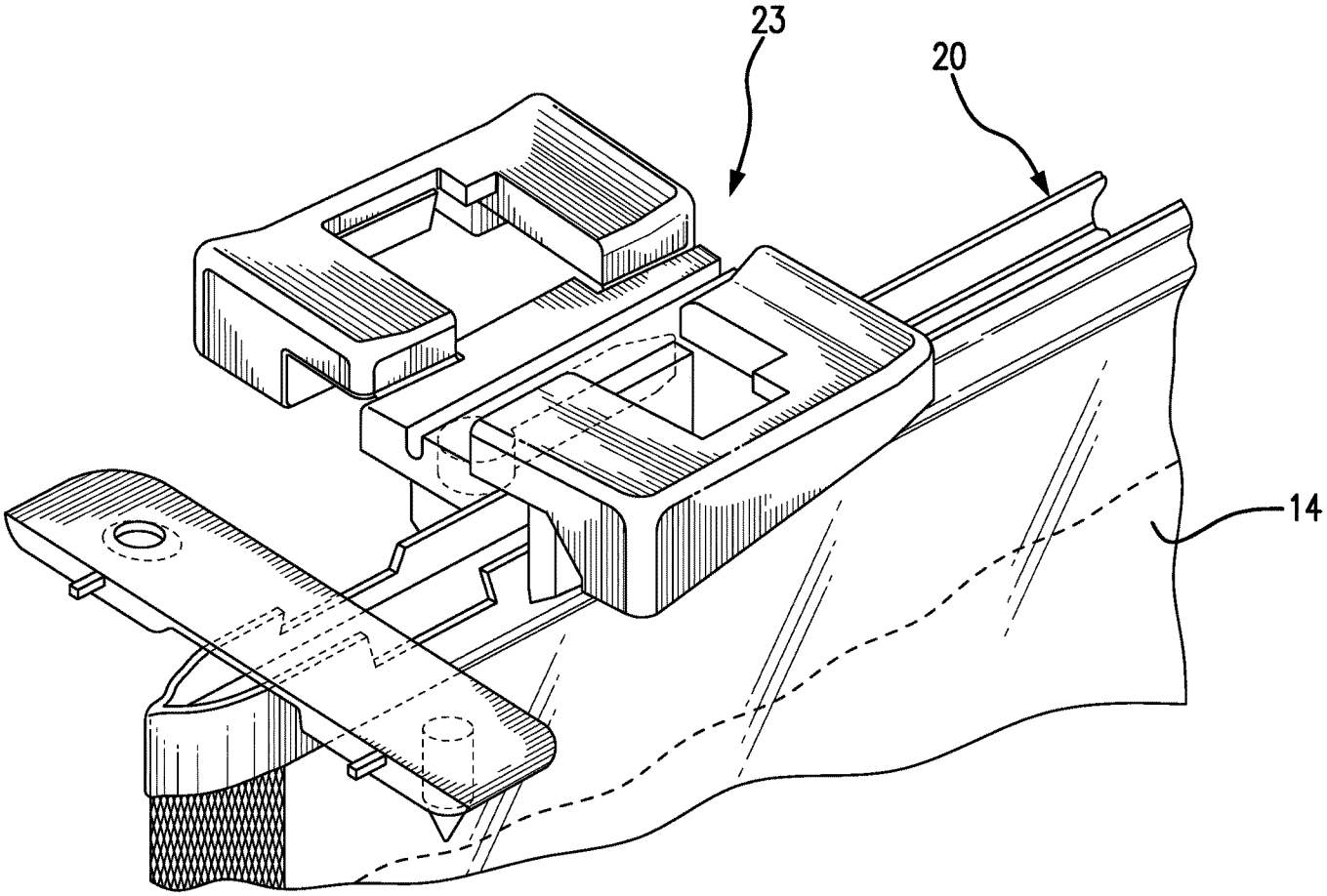
FIG. 10 is a perspective view of the reclosable fastener with self locking slider shown in open position preparatory to assembly.
Figure 11:
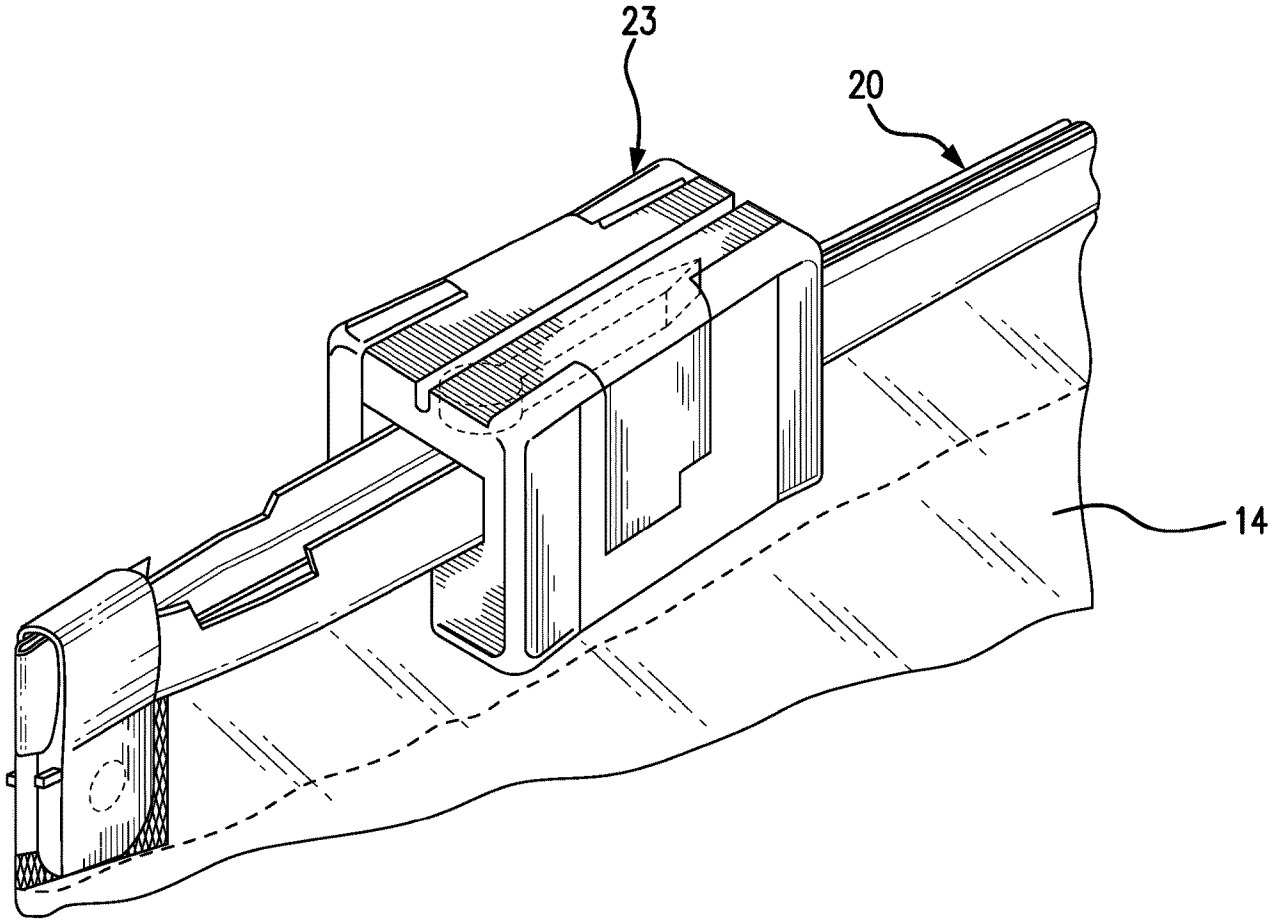
FIG. 11 is a perspective view of the reclosable fastener and self-locking slider in assembled position on a thermoplastic bag.

In further accordance with the invention, and as depicted in FIGS. 9, 10 and 11, the reclosable fastener comprises a pair of flexible plastic strips having separable fastener means extending along the length thereof comprising reclosable interlocking male and female profile elements on the respective strips. The strips include profiled tracks extending along the length thereof parallel to the male and female elements The slider is provided with a separator finger and interlocking complementary structure formed from plastic for moving along the fastener in straddling relation. The complementary structure comprises a transverse support member having the separator finger depending therefrom. The support member is positioned on the top edges of the tracks with the separator finger inserted therebetween. A pair of side walls are positioned on the opposite sides of the support member for receiving the pair of strips therebetween, the separator finger and the side walls extend from an opening end of the slider to a closing end. The separator finger is wider at the opening end of the slider than at the closing end of the slider and the side walls are spaced wider apart at the opening end to permit separation of the male and female elements by the wider end of the separator finger extending between the side walls at the opening end. The side walls are spaced sufficiently close together at the closing end to press the male and female elements into interlocking relationship as the slider is moved in a fastener closing direction. There is further provided means for restraining the slider in closed position and maintaining the male and female elements in interlocking relation when the slider reaches the closed end of its travel along its tracks comprising a protrusion on the wider end of the separator finger adjacent the opening end of the slider and notch structure at the adjacent end of the tracks. The notch structure has an end located on the tracks to permit the wider end of the separator finger to move beyond the end from between the tracks and into the notch structure. The protrusion is engageable with the end of the notch structure when the slider is at the closed end of its travel on the tracks thereby restraining the wider end of the separator finger from moving out of the notch structure and between the tracks and inadvertently opening the male and female elements of the fastener, as shown and described in U.S. Pat. No. 5,067,208 to Herrington, Jr., the entire contents of which is incorporated herein by reference thereto.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reclosable bag comprising:

a first panel including a first side section and a second side section;

a second panel including a first side section and a second side section, the first panel opposing the second panel and joined to the second panel along the first and second side sections;

a bottom connecting the first and second panels to each other;

a reclosable top disposed opposite the bottom and extending between the first and second side sections of the first and second panels;

a closure assembly extending along the reclosable top and configured to open and close the reclosable top; and a handle assembly joined to the first panel, the handle assembly including a first handle section formed of a separate handle panel and having a top section, a bottom section, opposing first and second side edges and an opening defined in a central section thereof, wherein the closure assembly is transitionable between a first position relative the top section of the first handle section and a second position relative the top section of the first handle section, the top section of the first handle section being disposed below the closure assembly in the first position, wherein the bottom section of the first handle section is joined along an entire width to the first panel, the first and second side edges are joined along an entire height of the first and second side edges to the first and second side sections, respectively, and the top section of the first handle section is unattached to the first panel.

2. The bag of claim 1, further comprising a second handle section joined to the second panel.

3. The bag of claim 2, wherein the second handle section includes a bottom section joined along a width to the second panel, first and second side edges joined to the first and second side sections of the second panel, respectively, and an opening defined in a central section thereof.

4. The bag of claim 3, wherein the opening defined in the second handle section is axially aligned with the opening defined in the first handle section.

5. The bag of claim 2, wherein each of the first and second handle sections has a width that is substantially equal to the width of the first and second panels, respectively.

6. The bag of claim 2, wherein the top section of each of the first and second handle sections is disposed about 0.25 inch below the closure assembly.

7. The bag of claim 1, wherein the handle assembly is formed from two layers of polymeric film.

8. The bag of claim 1, wherein the first and second panels are formed by two separate sheets.

9. The bag of claim 1, wherein the first and second panels are formed from one sheet, the sheet folded to form first and second panels.

10. The bag of claim 1, wherein each of the first and second panels are formed from a polymeric material.

11. The bag of claim 10, wherein the polymeric material is selected from the group consisting of polyesters; polystyrenes; nylon; polypropylene; polyethylene; copolymers of polyethylene and polypropylene; polycarbonates; polyacetals; acrylic-butadiene-styrene copolymers; monolayer or multilayer polyethylene, such as a low density polyethylene (LDPE), a linear low density polyethylene (LLDPE), high density polyethylenes (HDPE), and/or ethylene vinyl acetate, and/or a co-polymer mixture, multilayer combination, or laminate(s) thereof; or combinations thereof.

12. The bag of claim 1, wherein the closure assembly includes a zipper extending along the reclosable top.

13. The bag of claim 12, wherein the zipper includes a rib profile and a groove profile, the rib profile and the groove profile configured to form an interlocking relationship when the zipper is in a closed position and further wherein the interlocking relationship between the rib and groove profiles is disengaged when the zipper is in an open position.

14. The bag of claim 13, wherein the zipper includes a slider slidably mounted to the zipper, the slider configured to open and close the zipper, wherein the rib profile and the groove profile are configured to form an interlocking relationship when the slider is in a closed position and further wherein the interlocking relationship between rib and groove profiles is disengaged when the slider is in an open position.

15. The bag of claim 1, wherein the closure assembly includes a fastener extending along the reclosable top, the fastener configured to close the reclosable top when a pinching force or pressure is applied to the fastener.

16. The bag of claim 15, wherein the fastener comprises a first fastener track attached to the first panel and a second fastener track attached to the second panel, wherein first and second fastener tracks are disposed in an opposing relationship on the first and second panels, respectively.

17. The bag of claim 16, wherein the first and second fastener tracks comprise integrally formed profiles and fins.

18. The bag of claim 15, wherein the closure assembly further includes a slider configured to open and close the fastener.

19. The bag of claim 1, wherein the closure assembly transitions from the first position disposed above the defined opening of the first handle section to the second position disposed below the defined opening of the first handle section.

20. The bag of claim 1, wherein the handle assembly further includes a second handle section formed of a second handle panel attached to the second panel.

21. A reclosable bag comprising:

a first panel including a first side section and a second side section;

a second panel including a first side section and a second side section, the first panel opposing the second panel and joined to the second panel along the first and second side sections;

a bottom connecting the first and second panels to each other;

a reclosable top disposed opposite the bottom and extending between the first and second side sections of the first and second panels;

a closure assembly extending along the reclosable top and configured to open and close the reclosable top; and a handle assembly including a first handle section formed from the first panel and having a top section, a bottom section, opposing first and second side edges and an opening defined in a central section thereof, the first handle section including a folded length of the first panel to define a first lateral wing extending downwardly from the top section of the first handle section and sealed to the first panel along the bottom section of the first handle section, wherein the first panel extends upwardly from the bottom section of the first handle section to define the reclosable top, and further wherein the closure assembly is transitionable between a first position relative the top section of the first handle section and a second position relative the top section of the first handle section, the top section of the first handle section being disposed below the closure assembly in the first position, and the first and second side edges are joined along an entire height of the first and second side edges to the first and second side sections, respectively.

22. The bag of claim 21, wherein the handle assembly further includes a second handle section formed by a folded length of the second panel.

23. The reclosable bag of claim 21, wherein the reclosable top extends an entire width between the first and second side sections of the first and second panels.

* * * * *